US007828232B2

(12) United States Patent
Oomori et al.

(10) Patent No.: US 7,828,232 B2
(45) Date of Patent: Nov. 9, 2010

(54) INJECTION VALVE HAVING NOZZLE HOLE

(75) Inventors: Ryutaro Oomori, Aichi-gun (JP); Akio Imai, Kariya (JP); Tetsuharu Matsuo, Chita-gun (JP)

(73) Assignee: Denso Corporation, Kariya (JP)

( * ) Notice: Subject to any disclaimer, the term of this patent is extended or adjusted under 35 U.S.C. 154(b) by 521 days.

(21) Appl. No.: 11/405,422

(22) Filed: Apr. 18, 2006

(65) Prior Publication Data

US 2006/0243829 A1 Nov. 2, 2006

(30) Foreign Application Priority Data

Apr. 18, 2005 (JP) ..... 2005-119469
Jan. 12, 2006 (JP) ..... 2006-004711
Feb. 7, 2006 (JP) ..... 2006-029665

(51) Int. Cl.
*F02M 51/00* (2006.01)

(52) U.S. Cl. ..... 239/585.1; 239/288.5; 239/491; 239/575; 239/585.5; 239/590.5; 239/533.11; 239/596; 239/104; 239/106

(58) Field of Classification Search ..... 239/462, 239/463, 482, 491, 493, 533.12, 575, 584, 239/585.1, 585.4, 585.5, 590, 590.5, 533.11, 239/288.5, 596, 104, 106
See application file for complete search history.

(56) References Cited

U.S. PATENT DOCUMENTS 5,193,747 A 3/1993 Preussner
5,271,565 A * 12/1993 Cerny ..... 239/585.1
5,823,444 A 10/1998 Reiter et al.
5,979,801 A * 11/1999 Munezane et al. ..... 239/533.12
6,015,103 A * 1/2000 Kotkowicz ..... 239/585.4
6,783,087 B2 8/2004 Aoki et al.

FOREIGN PATENT DOCUMENTS

JP 03-5972 U 1/1991
JP 05-019558 3/1993

(Continued)

OTHER PUBLICATIONS

Office Action and English translation in counterpart application CN 200610075265.3 issued Oct. 12, 2007.

(Continued)

*Primary Examiner*—Steven J Ganey
(74) *Attorney, Agent, or Firm*—Nixon & Vanderhye PC

(57) ABSTRACT

A fuel injection valve includes a valve body having a valve seat, a nozzle plate arranged on an injection side of the valve body, a valve plug for intermitting fuel injection through the nozzle hole, and a sleeve. The nozzle plate has a nozzle hole through which fuel is injected from the injection side of the valve body. The sleeve makes contact with an end surface of the nozzle plate on an opposite side of the valve body with respect to the nozzle plate to partially cover the nozzle plate. Fuel is injected to an outside of the sleeve through the nozzle hole of the nozzle plate and an opening of the sleeve. The end surface of the nozzle plate makes contact with the sleeve in a contact portion. The contact portion has at least one groove that extends from the opening outwardly with respect to a substantially radial direction of the sleeve.

6 Claims, 8 Drawing Sheets

FOREIGN PATENT DOCUMENTS

| | | |
|---|---|---|
| JP | 05-19558 U | 3/1993 |
| JP | 7-25271 | 5/1995 |
| JP | 9-236062 | 9/1997 |
| JP | 2002-48034 | 2/2002 |
| JP | 2002-206469 | 7/2002 |
| JP | 2003-262170 | 9/2003 |
| JP | 2004-27857 | 1/2004 |
| JP | 2005-180199 | 7/2005 |
| JP | 2005-233048 | 9/2005 |
| JP | 2005-249618 | 9/2005 |
| WO | 03/027489 A1 | 4/2003 |

OTHER PUBLICATIONS

Chinese Office Action dated Sep. 26, 2008 issued in counterpart Chinese Application No. 2006-10075265.3, with English translation.
Chinese Office Action dated Feb. 6, 2009, issued in corresponding Chinese Application No. 200610075265.3, with English translation.
Japanese Office Action dated Apr. 28, 2009, issued in counterpart Japanese Application No. 2006-029665, with English translation.
Japanese Office Action dated Oct. 8, 2009, issued in corresponding Japanese Application No. 2006-004711, with English translation.

* cited by examiner

INJECTION VALVE HAVING NOZZLE HOLE

CROSS REFERENCE TO RELATED APPLICATIONS

This application is based on and incorporates herein by reference Japanese Patent Applications No. 2005-119469 filed on Apr. 18, 2005, No. 2006-4711 filed on Jan. 12, 2006, and No. 2006-29665 filed on Feb. 7, 2006.

FIELD OF THE INVENTION

The present invention relates to an injection valve for injecting fuel through a nozzle hole.

BACKGROUND OF THE INVENTION

In recent years, a regulation of exhaust emission becomes further strict, and reduction in fuel consumption of an engine is further required. In general, it is necessary to accurately control a shape of spray of fuel injected from a fuel injection valve and an injection amount of fuel, in order to conform to the regulation of exhaust emission and requirement of reduction in fuel consumption of an engine. Therefore, a fuel injection valve needs to be adjusted respectively to each engine and each vehicle in order to satisfy various kinds of injection characteristics, which are different for each engine and vehicle. According to JP-A-2005-180199, a nozzle plate having a nozzle holes is provided to a tip end of a fuel injection valve to facilitate adjustment of the injection characteristics of the fuel injection valve. In this structure, the injection characteristic of the fuel injection valve can be modified by changing the nozzle plate, without changing the basic structure of the fuel injection valve.

However, the nozzle plate has small nozzle holes. Accordingly, injected fuel is apt to remain around the nozzle holes. This remaining fuel may be solidified by being exposed to high temperature combustion gas, or subsequent to elapsing time after engine stop. This solidified fuel may accumulate as deposit around the jet nozzle. When deposit is accumulated around the nozzle holes, a spray direction, in which fuel is sprayed through the nozzle hole, and a shape of fuel spray may change. As a result, the performance of the injection valve may not be maintained.

According to JP-A-2002-206469, the outer circumferential periphery of the nozzle hole has a recession. In the structure disclosed in JP-A-09-236062, the segment around the nozzle hole protrudes along the spray direction, and the outer circumferential periphery of the nozzle hole is backwardly recessed, so that the space is formed around the nozzle hole. In this structure, fuel supplied through the nozzle hole is introduced into this space, so that the fuel is restricted from being deposited around the nozzle hole.

According to JP-A-2004-27857, the volume of the recession, in which the nozzle hole is formed, is reduced, so that the amount of fuel accumulating in the recession is reduced. Thus, the amount of deposit of fuel accumulating around the nozzle hole is reduced. In the structure disclosed in JP-A-2003-262170, the heat plate covers around the nozzle hole, so that the segment around the nozzle hole is restricted from being exposed to flame in the combustion chamber. In addition, the gap circumferentially formed between the heat plate and the nozzle hole is utilized as a thermally insulating body, so that fuel around the nozzle hole is restricted from becoming deposit due to increase in temperature around the nozzle hole.

According to JP-A-2002-48034, fuel around the nozzle hole is introduced to the radially outer side along the drain groove, thereby being restricted from becoming deposit.

However, in the structure disclosed in JP-A-2002-206469 and JP-A-09-236062, the space introducing fuel around the nozzle hole is formed on the surface on the radially outer side of the nozzle hole. Accordingly ,the space does not have a structure for sufficiently draining fuel from the nozzle hole.

In the structure disclosed in JP-A-2004-27857, fuel accumulating around the recession, in which the nozzle hole is formed, is reduced. In this structure, fuel is not necessarily removed from the nozzle hole.

In the structure disclosed in JP-A-2003-262170, the gap is circumferentially formed entirely between the heat plate and the surface around of the nozzle hole. In this structure, fuel introduced from the nozzle hole into the gap makes contact with only the surface around the nozzle hole and the surface of the heat plate. In this structure, fuel cannot be guided sufficiently into the gap. Accordingly, fuel cannot be removed from the nozzle hole.

In the above four patent documents, fuel may remain around the nozzle hole, consequently, remaining fuel may gradually accumulate to be deposit.

In the disclosure of JP-A-2002-48034, fuel around the nozzle hole is guided to the radially outer side along the drain groove utilizing gravitational force. Accordingly, the tilt angle of the fuel injection valve and the screwed angle of the fuel injection valve define the arrangement of the draining groove. In this structure, the tilt angle of the fuel injection valve and the screwed angle of the fuel injection valve need to be adjusted, consequently, an assembling work of the fuel injection valve becomes complicated.

SUMMARY OF THE INVENTION

In view of the foregoing and other problems, it is an object of the present invention to produce a fuel injection valve that has a structure, in which fuel can be restricted from accumulating around a nozzle hole.

According to one aspect of the present invention, A fuel injection valve includes a valve body, a nozzle plate, a valve plug, and a sleeve. The valve body has a valve seat. The nozzle plate is arranged on an injection side of the valve body. The nozzle plate has a nozzle hole through which fuel is injected from the injection side of the valve body. The valve plug is located on an opposite side of the nozzle plate with respect to the valve body. The valve plug is adapted to intermitting fuel injection through the nozzle hole by being seated onto the valve seat and by being lifted from the valve seat. The sleeve makes contact with an end surface of the nozzle plate on an opposite side of the valve body with respect to the nozzle plate. The sleeve partially covers the nozzle plate. The sleeve has an opening, through which fuel is injected to an outside of the sleeve after passing through the nozzle hole of the nozzle plate. The nozzle plate and the sleeve define a contact portion, in which the end surface of the nozzle plate makes contact with the sleeve. The contact portion has at least one groove that extends from the opening outwardly with respect to a substantially radial direction of the sleeve.

Alternatively, the sleeve has a circumferential periphery around the opening. The circumferential periphery of the sleeve makes contact with the end surface of the nozzle plate. The circumferential periphery has a substantially comb teeth shape.

Alternatively, a fuel injection valve includes a valve body, a nozzle plate, and a sleeve. The valve body has a valve seat. The nozzle plate is located on an injection side of the valve body. The nozzle plate has a nozzle hole, through which fuel is injected from the injection side of the valve body. The sleeve partially covers an end of the nozzle plate on an opposite side of the valve body with respect to the nozzle plate. The sleeve has an opening on the opposite side of the valve body with respect to the nozzle plate. The opening is defined by an inner circumferential periphery, through which fuel, which is injected through the nozzle hole, passes. The sleeve has a groove that extends from the inner circumferential periphery outwardly with respect to a substantially radial direction of the sleeve.

Thus, fuel injected through the nozzle hole can be restricted from accumulating around the nozzle hole.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
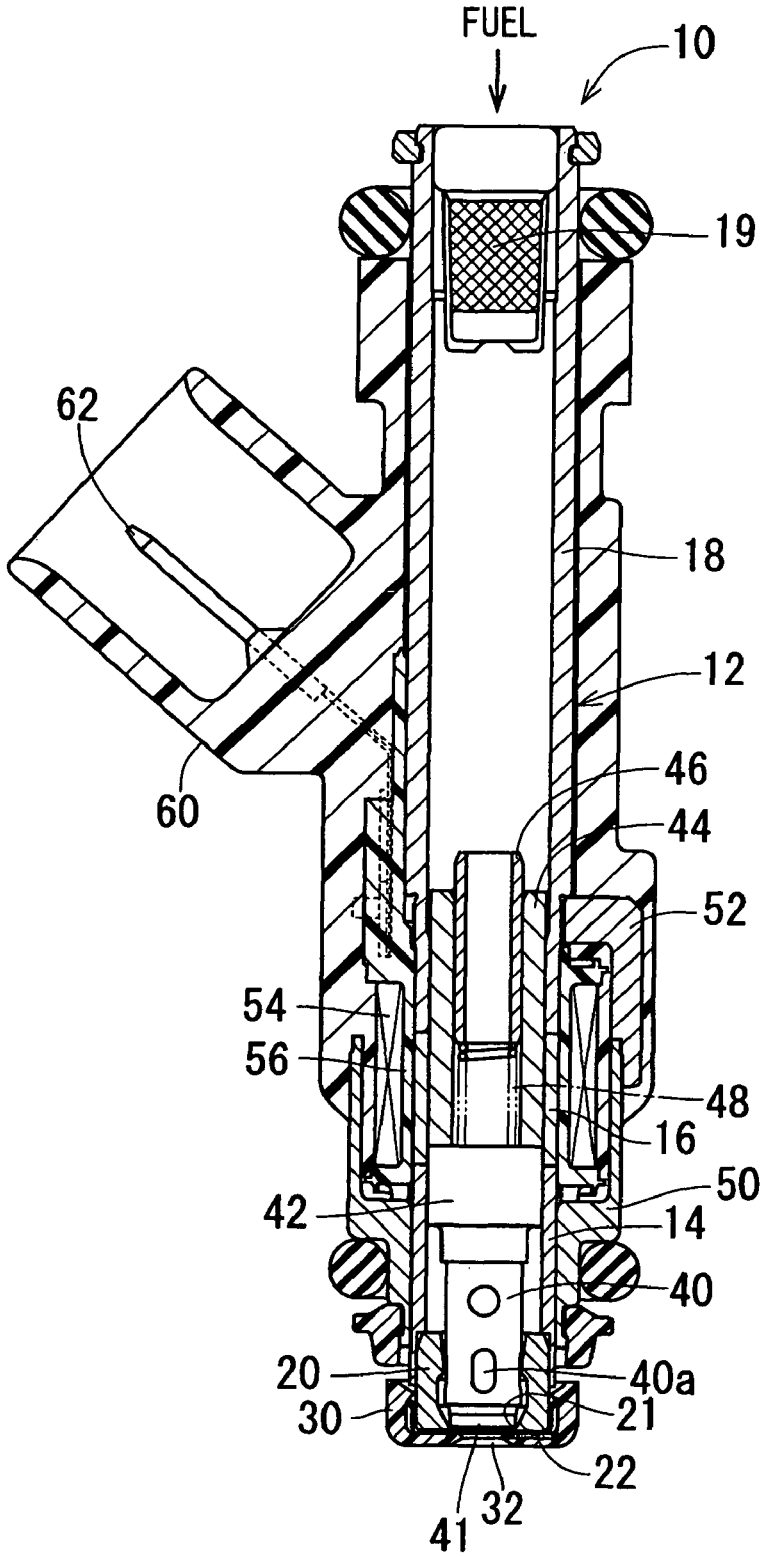
FIG. 1 is a partially cross sectional side view showing a fuel injection valve, according to a first embodiment of the present invention.
Figure 2A:
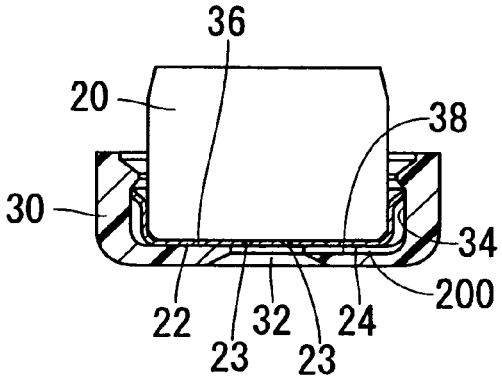
FIG. 2A is a partially cross sectional side view showing a nozzle plate and a bottom portion of a sleeve of the fuel injection valve.
Figure 2B:
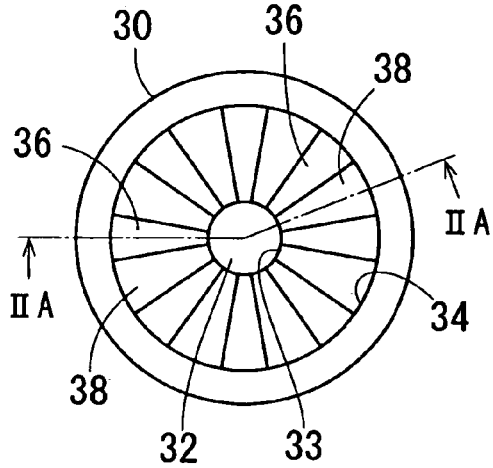
FIG. 2B is a top view showing the inside of the sleeve, according to the first embodiment.

A fuel injection valve 10 of this embodiment is described in reference to FIGS. 1, 2A, and 2B. FIG. 2A is the partially cross sectional side view taken along the line IIA-IIA in FIG. 2B.

The fuel injection valve 10 shown in FIG. 1 is a fuel injection valve for a gasoline engine having a port injection structure, for example. This fuel injection valve 10 injects fuel into intake air flowing through an intake passage. The fuel injection valve 10 has a cylindrical member 12 that is formed of a magnetic material and a non-magnetic material to be in a substantially cylindrical shape. The cylindrical member 12 accommodates a fuel filter 19, a valve body 20, a valve plug (valve member) 40, a movable core 42, a fixed core 44, an adjusting pipe 46, a spring 48, and the like. The spring 48 serves as a bias member. The cylindrical member 12 includes a first magnetic member 14, a non-magnetic member 16, and a second magnetic member 18 arranged in this order from the side of a valve body 20 on the lower side in FIG. 1. The non-magnetic member 16 serves as a magnetically resistant member. The cylindrical member 12 is arranged on the radially inner side of a coil 54. The cylindrical member 12 surrounds the outer circumferential peripheries of the movable core 42 and the fixed core 44. The first magnetic member 14 is arranged on the radially outer side of the movable core 42, thereby surrounding the outer circumferential periphery of the movable core 42. The first magnetic member 14, the non-magnetic member 16, and the second magnetic member 18 are connected with each other by laser welding or the like. The non-magnetic member 16 restricts the first magnetic member 14 and the second magnetic member 18 from causing magnetically short circuit therebetween. The cylindrical member 12 has a fuel inlet, in which the fuel filter 19 is provided.

The valve body 20 is welded to the inner circumferential periphery of the tip end of the first magnetic member 14 on the side of nozzle holes 23, thereby being fixed to the first magnetic member 14. The valve body 20 has the inner circumferential periphery, which defines a valve seat 21, onto which the valve plug 40 is adapted to be seated. The bottom outer wall of the valve body 20 on the side (injection side) of fuel injection is welded to a nozzle plate 22 being in a cup shape, so that the valve body 20 is fixed to the nozzle plate 22. The nozzle plate 22 has a center portion, in a substantially thin plate shape, having the multiple nozzle holes 23 (FIGS. 2A).

As shown in FIGS. 2A, 2B, a sleeve 30 is formed of resin to be in a substantially cup shape, for example. The sleeve 30 makes contact with an injection side end surface 24 of the nozzle plate 22 on the injection side, thereby covering the nozzle plate 22. The sleeve 30 has an opening 32 that surrounds the outer circumferential periphery of a nozzle portion, in which the nozzle holes 23 are formed in the nozzle plate 22. The fuel injection valve 10 injects fuel into an intake pipe through the nozzle holes 23 and the opening 32.

The sleeve 30 makes contact with the injection side end surface 24 of the nozzle plate 22 via a contact portion. The sleeve 30 has contact surfaces 36 and grooves 38 formed in the contact portion. The sleeve 30 makes contact with the injection side end surface 24 of the nozzle plate 22 via the contact surfaces 36. The contact surfaces 36 and the grooves 38 respectively extend from an opening end 33 of the opening 32 to an inner circumferential surface 34 of the sleeve 30 on the radially outer side. Each of the contact surfaces 36 and each of the grooves 38 are arranged circumferentially one after another. The groove 38 has the circumferential width, which is greater than the circumferential width of the contact surface 36 with respect to the circumferential direction thereof.

As referred to FIG. 1, the valve plug 40 is a hollow member being in a substantially bottomed cylindrical shape. The valve plug 40 has a contact portion 41 on the bottom side thereof. The contact portion 41 is adapted to being seated onto the valve seat 21 of the valve body 20. When the contact portion 41 is seated onto the valve seat 21, the nozzle hole 23 is blocked, thereby terminating fuel injection. The contact portion 41 of the valve plug 40 has multiple fuel ports 40*a* on the upstream side thereof. The fuel ports 40*a* are through holes penetrating though the sidewall of the valve plug 40. Fuel flows into the valve plug 40, and passes from the inside of the valve plug 40 to the outside of the valve plug 40 through the fuel ports 40*a*, and thereafter, the fuel flows to a valve portion constructed of the contact portion 41 of the valve plug 40 and the valve seat 21 of the valve body 20.

The movable core 42 is fixed to the valve plug 40 on the opposite side of the valve body 20 by welding or the like. A spring 48 biases the movable core 42 and the valve plug 40 in the direction, in which the valve plug 40 is seated onto the valve seat 21 of the valve body 20.

The fixed core 44 is in a substantially cylindrical shape, and is accommodated in the cylindrical member 12. The fixed core 44 is arranged on the opposite side of the valve body 20 with respect to the movable core 42, thereby axially opposing to the movable core 42. The adjusting pipe 46 is press-inserted into the fixed core 44, thereby latches one end of the spring 48. The length, by which the adjusting pipe 46 is press-inserted into the fixed core 44 is adjusted, so that biasing force of the spring 48 can be adjusted.

The magnetic members 50, 52 are arranged on the radially outer side of the coil 54 such that the magnetic members 50, 52 and the coil 54 are magnetically connected with each other. The magnetic member 50 magnetically connects with the first magnetic member 14, and the magnetic member 52 magnetically connects with the second magnetic member 18. In this structure, the fixed core 44, the movable core 42, the first magnetic member 14, the magnetic members 50, 52, and the second magnetic member 18 construct a magnetic circuit.

The coil 54 is wound around a spool 56, which is provided to the outer circumferential periphery of the cylindrical member 12. The outer circumferential peripheries of the cylindrical member 12 and the coil 54 are surrounded by a resinous housing 60. The coil 54 electrically connects with a terminal 62, so that the coil 54 is supplied with electricity through the terminal 62.

As referred to FIG. 1, fuel flows into the cylindrical member 12 through the fuel filter 19, and the fuel is injected through the nozzle holes 23, after passing through a fuel passage formed in the fuel injection valve 10. This fuel passage in the fuel injection valve 10 is constructed of a fuel passage in the fixed core 44, a fuel passage in the movable core 42, a fuel passage in the valve plug 40, the fuel port 40*a*, and the gap defined between the contact portion 41 and the valve seat 21 when the contact portion 41 is lifted from the valve seat 21.

In this structure of the fuel injection valve 10, when supplying electricity to the coil 54 is terminated, the valve plug 40 is biased by the biasing force of the spring 48 to the lower side in FIG. 1, in the direction in which the fuel injection valve 10 closes. The contact portion 41 of the valve plug 40 is seated onto the valve seat 21, so that the nozzle holes 23 are blocked, and fuel injection is terminated.

When the coil 54 is supplied with electricity, magnetic flux passes through the magnetic circuit constructed of the fixed core 44, the movable core 42, the first magnetic member 14, the magnetic members 50, 52, and the second magnetic member 18, so that the fixed core 44 and the movable core 42 generate magnetic attraction force therebetween. In this condition, the valve plug 40 moves to the side of the fixed core 44 together with the movable core 42 against the biasing force of the spring 48, so that the contact portion 41 is lifted from the valve seat 21. Thus, fuel is injected through the nozzle holes 23. The movable core 42 is latched by the fixed core 44, so that the maximum lift of the valve plug 40 is defined.

During fuel injection, negative pressure is applied to the nozzle holes 23 and the passage around the nozzle holes 23. This negative pressure is generated by flow of fuel to be injected trough the nozzle holes 23. Therefore, fuel, which adheres to the nozzle holes 23 of the nozzle plate 22 and the injection side end surface 24 around the nozzle plate 22, is attracted to fuel spray, so that the adhering fuel can be injected into the intake pipe.

Thereafter, when the engine stops, the fuel injection valve 10 stops fuel injection. In this condition, fuel, which adheres to the nozzle holes 23 of the nozzle plate 22 and the injection side end surface 24 around the nozzle plate 22, is attracted to a space 200 (FIG. 2) by surface tension applied to fuel making contact with the entire inner circumferential peripheries of the grooves 38. Thus, the fuel around the nozzle plate 22 can be removed from the nozzle holes 23 and the vicinity of the nozzle holes 23. Therefore, fuel can be restricted from accumulating in the nozzle holes 23 and in the vicinity of the nozzle holes 23 when the engine stops, so that deposit can be restricted from accumulating in the nozzle holes 23 and in the vicinity of the nozzle holes 23.

The circumferential width of the groove 38 with respect to the circumferential direction thereof is greater than the circumferential width of the contact surface 36, which is arranged between the grooves 38 circumferentially adjacent to each other. Therefore, the surface areas of the entire circumferential inner peripheries of the grooves 38 become large, so that the attractive force generated by the surface tension attracting fuel into the space 200 becomes large. Furthermore, the volume of the space 200 becomes large, so that the amount of fuel attracted into the space 200 becomes large. The grooves 38 are arranged at a substantially regular interval with respect to the circumferential direction. Therefore, fuel in the nozzle holes 23 and in the vicinity of the nozzle holes 23 can be attracted to the space 200 substantially uniformly with respect to the circumferential direction thereof. In addition, fuel in the nozzle holes 23 and in the vicinity of the nozzle holes 23 is attracted into the space 200 by the surface tension, so that the fuel can be attracted into the space 200 regardless of the tilt angle of the fuel injection valve 10 and the rotation position of the sleeve 30, i.e., the screwed angle of the sleeve 30. Therefore, the assembling work of the fuel injection valve 10 can be facilitated.

When the engine restarts, fuel, which is not vaporized and is accumulated in the space 200, is drawn to the vicinity of the nozzle holes 23, and is injected together with fuel spray.

Second Embodiment

Figure 3A:
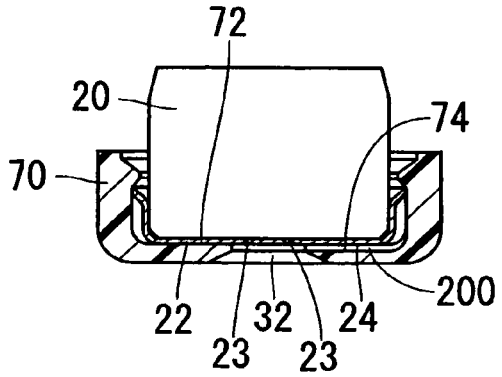
FIG. 3A is a partially cross sectional side view showing a nozzle plate and a bottom portion of a sleeve of the fuel injection valve.
Figure 3B:
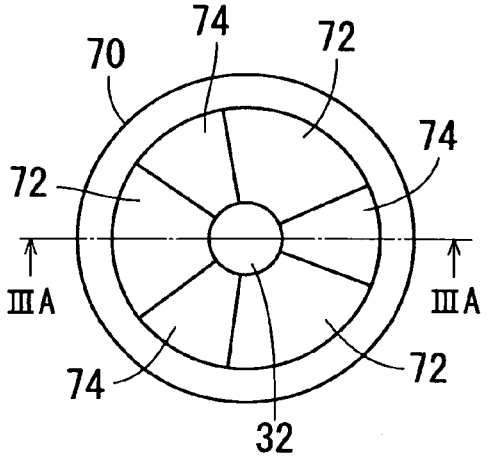
FIG. 3B is a top view showing the inside of the sleeve, according to a second embodiment of the present invention.

The fuel injection valve 10 of the second embodiment is described in reference to FIGS. 3A, 3B. FIG. 3A is the partially cross sectional side view taken along the line IIIA-IIIA in FIG. 3B.

A sleeve 70 has three contact surfaces 72 and three grooves 74. Each of the contact surfaces 72 and each of the grooves 74 are arranged circumferentially one after another. The contact surface 72 has the circumferential width, which is greater than the circumferential width of the groove 74 with respect to the circumferential direction thereof.

In this structure, the contact portion between the sleeve 70 and the nozzle plate 22 can be restricted from arising play, by circumferentially providing at least three contact surfaces 72 and grooves 74.

Third Embodiment

Figure 4A:
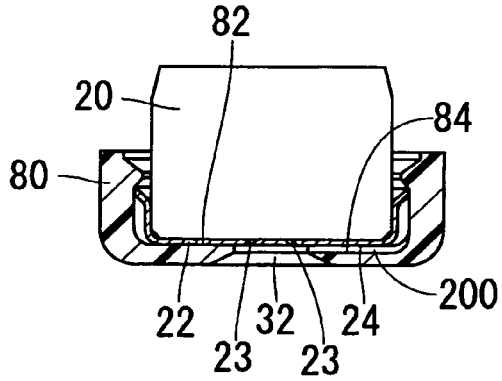
FIG. 4A is a partially cross sectional side view showing a nozzle plate and a bottom portion of a sleeve of the fuel injection valve.
Figure 4B:
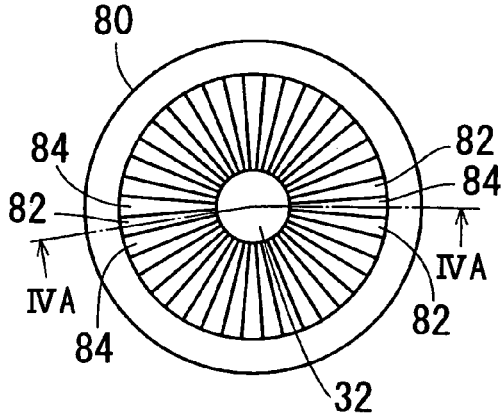
FIG. 4B is a top view showing the inside of the sleeve, according to a third embodiment of the present invention.

The fuel injection valve 10 of the third embodiment is described in reference to FIGS. 4A, 4B. FIG. 4A is the partially cross sectional side view taken along the line IVA-IVA in FIG. 4B.

A sleeve 80 has twenty contact surfaces 82 and twenty grooves 84, which are circumferentially arranged. In this embodiment, the numbers of the contact surfaces 82 and the grooves 84 are greater than those in the first embodiment.

Fourth Embodiment

Figure 5A:
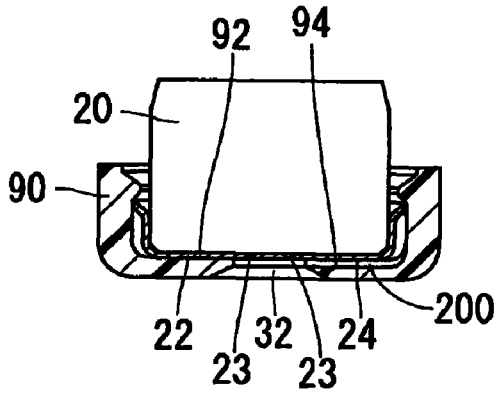
FIG. 5A is a partially cross sectional side view showing a nozzle plate and a bottom portion of a sleeve of the fuel injection valve.
Figure 5B:
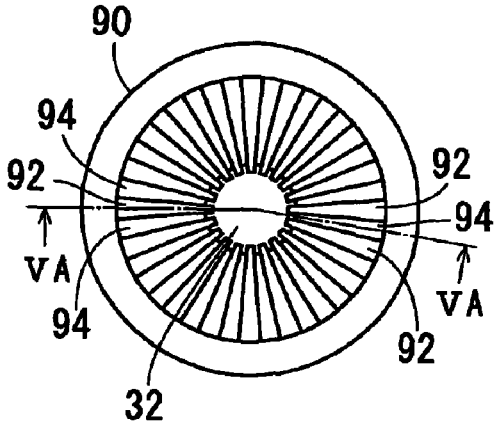
FIG. 5B is a top view showing the inside of the sleeve, according to a fourth embodiment of the present invention.

The fuel injection valve 10 of the fourth embodiment is described in reference to FIGS. 5A, 5B. FIG. 5A is the partially cross sectional side view taken along the line VA-VA in FIG. 5B.

A sleeve 90 has grooves 94 and contact surfaces 92. Each of the contact surfaces 92 radially protrudes into the opening 32 beyond the groove 94. In this structure, the surface area, which makes contact with fuel, increases in the gap between the injection side end surface 24 of the nozzle plate 22 and the sleeve 90, compared with the structure of the third embodiment. Therefore, surface tension, which attracts fuel from the nozzle holes 23 and the vicinity of the nozzle holes 23 into the space 200, increases, so that fuel can be readily attracted into the space 200.

Fifth Embodiment

Figure 6A:
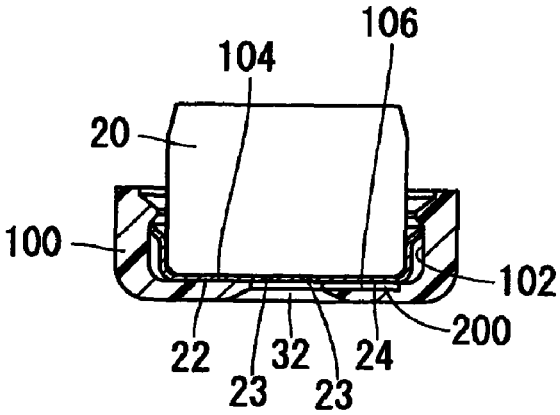
FIG. 6A is a partially cross sectional side view showing a nozzle plate and a bottom portion of a sleeve of the fuel injection valve.
Figure 6B:
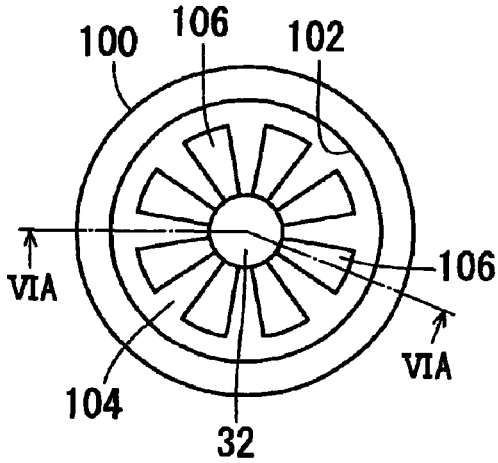
FIG. 6B is a top view showing the inside of the sleeve, according to a fifth embodiment of the present invention.

The fuel injection valve 10 of the fifth embodiment is described in reference to FIGS. 6A, 6B. FIG. 6A is the partially cross sectional side view taken along the line VIA-VIA in FIG. 6B.

A sleeve 100 has grooves 106 and contact surfaces 104. Each of the grooves 106 does not radially reach an inner circumferential periphery 104 of the sleeve 100, so that the radial length of each of the grooves 106 is less than the radial length of each of the contact surfaces 104.

Sixth Embodiment

Figure 7A:
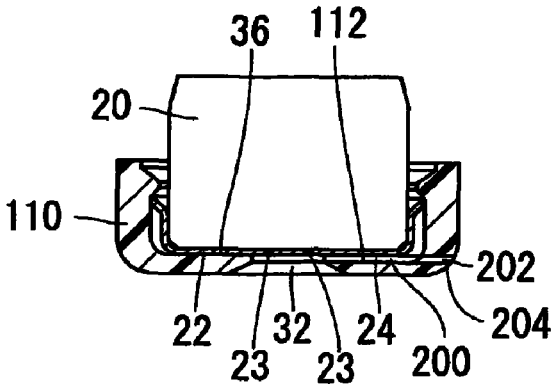
FIG. 7A is a partially cross sectional side view showing a nozzle plate and a bottom portion of a sleeve of the fuel injection valve.
Figure 7B:
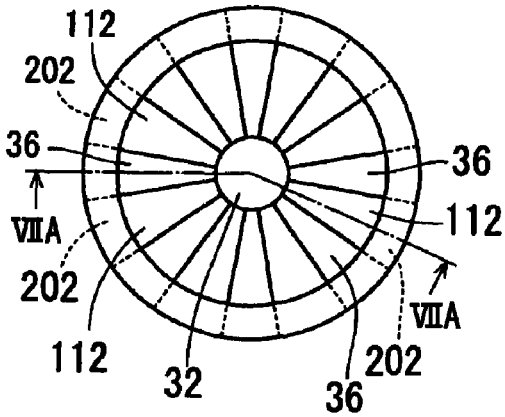
FIG. 7B is a top view showing the inside of the sleeve, according to a sixth embodiment of the present invention.

The fuel injection valve 10 of the sixth embodiment is described in reference to FIGS. 7A, 7B. FIG. 7A is the partially cross sectional side view taken along the line VIIA-VIIA in FIG. 7B.

A sleeve 110 has grooves 112 that respectively radially extend outwardly from the opening 32. Each of the grooves 112 radially penetrates the sleeve 110, thereby defining through hole 202 in the sleeve 110. In this structure, negative pressure is applied to the nozzle holes 23 and the vicinity of the nozzle holes 23 by injecting fuel because of the flow of fuel injected from the fuel injection valve 10. In this condition, air is vent from the through holes 202 to the opening 32 through the space 200, so that fuel, which adheres in the vicinity of the through holes 202 around an R portion 204 of the outer circumferential periphery of the sleeve 110, is attracted by the negative pressure on the side of the opening 32. Thus, the adhering fuel is injected together with fuel spray. Consequently, the fuel, which adheres in the vicinity of the through holes 202 around the R portion 204 of the sleeve 110, can be restricted from dropping from the sleeve 110 during fuel injection.

Seventh Embodiment

Figure 8A:
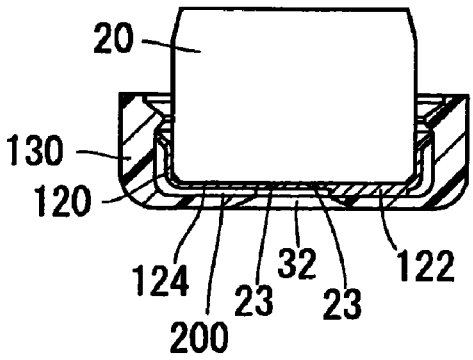
FIG. 8A is a partially cross sectional side view showing a nozzle plate and a bottom portion of a sleeve of the fuel injection valve.
Figure 8B:
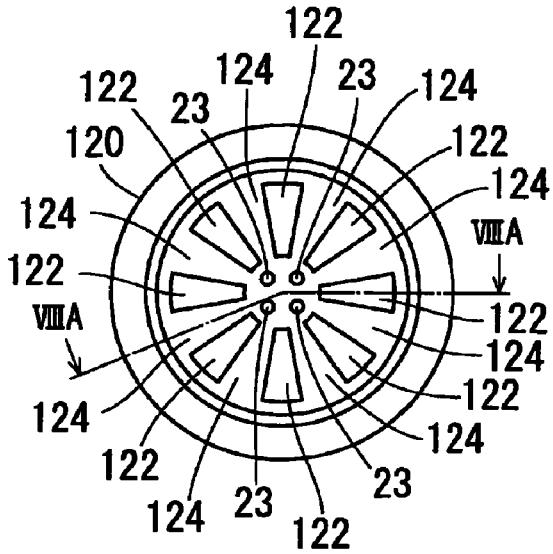
FIG. 8B is a top view showing the inside of the sleeve, according to a seventh embodiment of the present invention.

The fuel injection valve 10 of the seventh embodiment is described in reference to FIGS. 8A, 8B. FIG. 8A is the partially cross sectional side view taken along the line VIIIA-VIIIA in FIG. 8B.

In the above first to seventh embodiments, the grooves are formed in the sleeve. However, in this embodiment, grooves 124 are formed in a nozzle plate 120. In particular, protrusions 122 are circumferentially arranged in the nozzle plate 120 at substantially regular intervals with respect to substantially circumferential direction of the nozzle plate 120. The protrusions 122 protrude to the injection side. Each of the grooves 124 is formed between the protrusions 122, which are circumferentially adjacent to each other. A sleeve 130 has the inner bottom wall on the lower side in FIG. 8A. The inner bottom wall of the sleeve 130 has a substantially flat surface. The inner bottom wall of the sleeve 130 makes contact with the injection side end surface 24 of the protrusions 122.

Eighth Embodiment

Figure 9A:
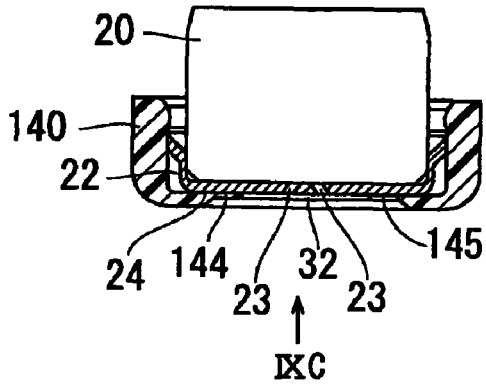
FIG. 9A is a partially cross sectional side view showing a nozzle plate and a bottom portion of a sleeve of the fuel injection valve.
Figure 9B:
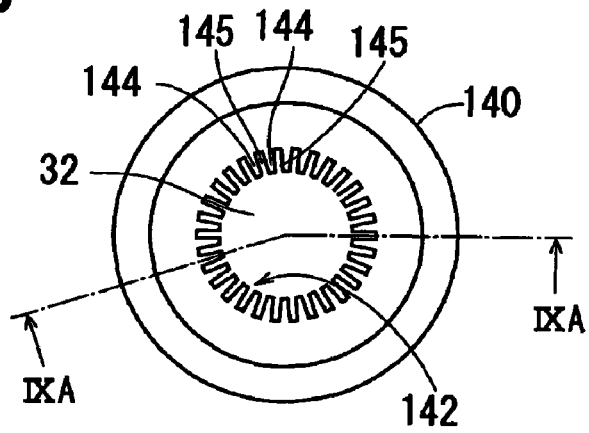
FIG. 9B is a top view showing the inside of the sleeve.
Figure 9C:
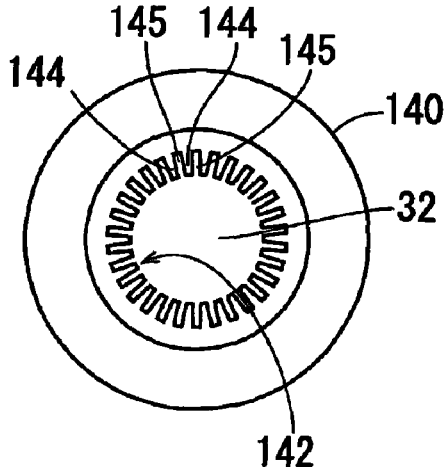
FIG. 9C is a view when being viewed from the arrow IXC in FIG. 9A, according to a eighth embodiment of the present invention.

The fuel injection valve 10 of the eighth embodiment is described in reference to FIGS. 9A, 9B, and 9C. FIG. 9A is the partially cross sectional side view taken along the line IXA-IXA in FIG. 9B.

A sleeve 140 is formed of resin to be in a substantially cup shape. The sleeve 140 makes contact with the injection side end surface 24 of the nozzle plate 22, so that the sleeve 140 covers the nozzle plate 22. The sleeve 140 has the opening 32 that surrounds the outer circumferential periphery of a nozzle portion, in which the nozzle holes 23 are formed. The opening 32 of the sleeve 140 has a circumferential periphery 142, in which comb teeth 144 are formed. The comb teeth 144 are arranged entirely around the circumferential periphery 142 of the opening 32 of the sleeve 140. The comb teeth 144 are circumferentially arranged around the circumferential periphery 142 at substantially regular intervals. Each of the comb teeth 144 radially extends to the opening 32 of the sleeve 140. The comb teeth 144 make contact with the injection side end surface 24 of the nozzle plate 22. Each of the comb teeth 144 has the circumferential width with respect to the circumferential direction of the sleeve 140. The circumferential widths of the comb teeth 144 are substantially regular with respect to each other. The comb teeth 144, which are circumferentially adjacent to each other, form a clearance 145 therebetween. This clearance 145 opens to the downstream side with respect to fuel injection. The clearances 145 are arranged circumferentially at substantially regular intervals, similarly to the comb teeth 144.

Fuel, which adheres to the nozzle holes 23 and to the injection side end surface 24 in the vicinity of the nozzle holes 23, is attracted by surface tension of fuel into the clearance 145 between the comb teeth 144, which surrounds the clearance 145, and the injection side end surface 24 of the nozzle plate 22. Thus, the fuel can be removed from the nozzle hole 23 and the vicinity of the nozzle hole 23. In this structure, fuel can be restricted from remaining in the nozzle holes 23 and in the vicinity of the nozzle holes 23, so that deposit can be restricted from accumulating in the nozzle holes 23 and in the vicinity of the nozzle holes 23.

In addition, the clearances 145 are arranged circumferentially at substantially regular intervals, and have the substantially regular circumferential width. Therefore, fuel in the nozzle holes 23 and in the vicinity of the nozzle holes 23 can be attracted to the clearance 145 substantially uniformly with respect to the circumferential direction thereof. Furthermore, fuel in the nozzle holes 23 and in the vicinity of the nozzle holes 23 is attracted into the clearance 145 by the surface tension. Therefore, the fuel can be attracted into the clearance 145 regardless of the tilt angle of the fuel injection valve 10 and the screwed angle of the sleeve 140. Therefore, the assembling work of the fuel injection valve 10 can be facilitated.

The structures of the nozzle plate, the injection side end surface of the nozzle plate, and the sleeve are not limited to those in the above embodiments. In particular, the number of the grooves, the depth of the grooves, the circumferential width of the grooves formed in the contact portion between the injection side end surface of the nozzle plate and the sleeve, and the like are not limited to those in the above embodiments. In addition, the number of the comb teeth, the depth of the comb teeth, the circumferential width of the comb teeth formed in the circumferential periphery of the opening of the sleeve, and the like are not limited to those in the above embodiments. The structures of the grooves, the comb teeth, and the like may be defined as appropriate, in accordance with the amount of fuel accumulating around the nozzle holes and the surface tension of fuel, for example.

The sleeve may be formed of a material other than resin.

The fuel injection valve of the above embodiments may be applied to a direct injection gasoline engine or a diesel engine, instead of being applied to a gasoline engine having a port injection structure, in which a fuel injection valve injects fuel into intake air flowing through an intake passage.

Ninth Embodiment

Figure 10A:
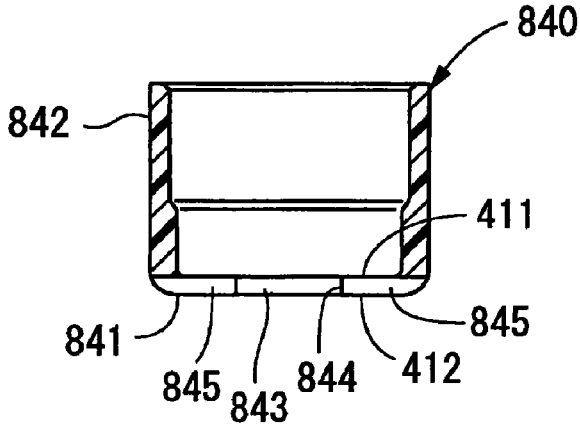
FIG. 10A is a cross sectional side view showing a sleeve of the fuel injection valve.
Figure 10B:
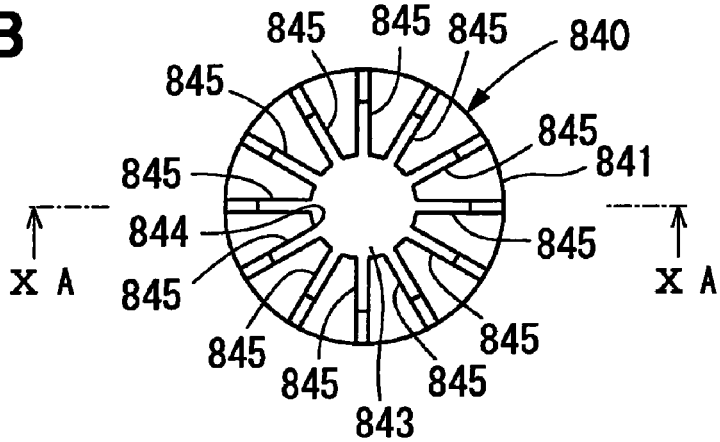
FIG. 10B is a bottom view of the sleeve, according to a ninth embodiment of the present invention.

A fuel injection valve 10 of this embodiment is described in reference to FIGS. 10A, 10B. FIG. 10A is the partially cross sectional side view taken along the line XA-XA in FIG. 10B.

When this fuel injection is terminated, fuel partially remains on the surface of the nozzle plate 22 on an injection side of the nozzle holes 23 around the opening 843 of the sleeve 840 on the lower side in FIG. 10A. That is, fuel partially remains on the surface of the nozzle plate 22 on the opposite side of the valve body 20. This remaining fuel intrudes into the grooves 845 from the inner circumferential periphery 844, which has the substantially linear cross section. The groves 845 respectively have the small circumferential width. Therefore, fuel accumulating in the opening 843 is drawn into the grooves 845 formed in the sleeve 840 by a capillary phenomenon. The inner circumferential periphery 844 is substantially linear, and is substantially in parallel with the center axis of the valve body 20, so that fuel accumulating around the opening 843 can be quickly drawn from the inner circumferential periphery 844 into the grooves 845.

The fuel drawn into the grooves 845 is introduced to the radially outer end of the sleeve 840 through the grooves 845 by the capillary phenomenon. This fuel introduced to the radially outer end of the sleeve 840 is evaporated in this radially outer end of the sleeve 840. Thus, fuel accumulating around the opening 843 is introduced to the radially outer end of the sleeve 840 through the grooves 845, and is evaporated, even when fuel injection is terminated. Therefore, fuel accumulating around the opening 843 on the injection side of the nozzle holes 23 can be removed. In addition, fuel can be restricted from being solidified around the nozzle holes 23, by removing fuel accumulating around the opening 843, so that deposit of fuel can be restricted from being formed around the nozzle holes 23. Thus, an amount of deposit accumulating around the nozzle holes 23 can be reduced.

Tenth Embodiment

Figure 11A:
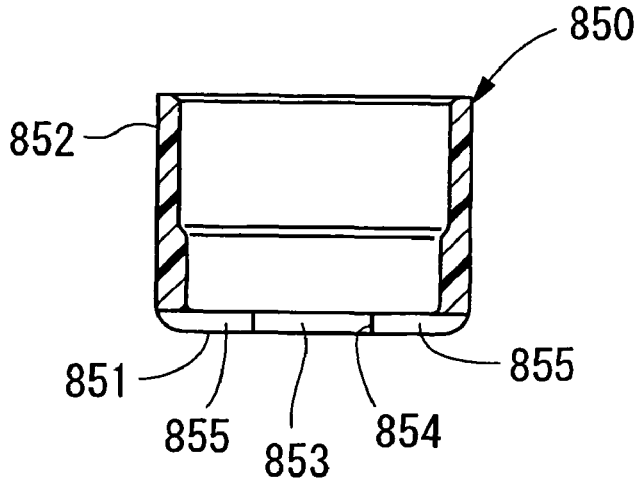
FIG. 11A is a cross sectional side view showing a sleeve of the fuel injection valve.
Figure 11B:
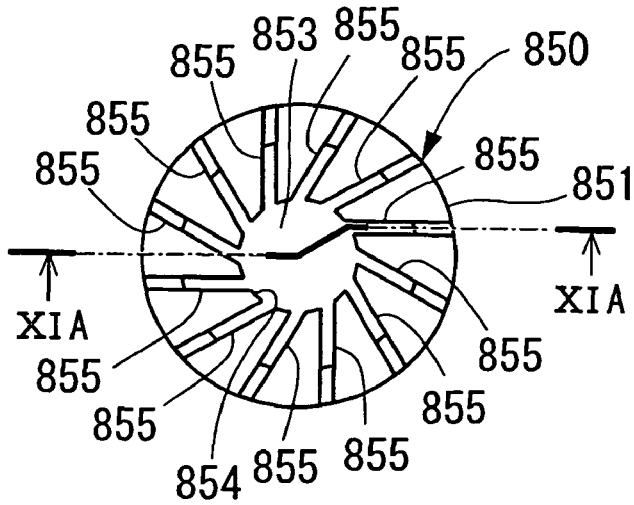
FIG. 11B is a bottom view of the sleeve, according to a tenth embodiment of the present invention.

The fuel injection valve 10 of the tenth embodiment is described in reference to FIGS. 11A, 11B. FIG. 11A is the partially cross sectional side view taken along the line XIA-XIA in FIG. 11B. FIG. 11B is a view showing a sleeve 850 when being viewed from the axially opposite side of-the fuel inlet of the fuel injection valve 10.

In this embodiment, the sleeve 850 has a bottom portion 851 and a cylindrical portion 852. The bottom portion 851 has a radially center portion having an inner circumferential periphery 854 defining an opening 853. The bottom portion 851 of the sleeve 850 has grooves 855 that are arranged in a substantially spiral shape. Specifically, each of the grooves 855 is inclined by a predetermined angle with respect to the tangent line of the inner circumferential periphery 854 defining the opening 853. The groove 855 may radially extend outwardly from the inner circumferential periphery 854 to the outer circumferential periphery of the bottom portion 851. Alternatively, the groove 855 may radially extend outwardly from the inner circumferential periphery 854 to a midway point between the inner circumferential periphery 854 and the outer circumferential periphery of the bottom portion 851.

In this embodiment, fuel accumulating around the opening 853 can be removed. In addition, an amount of deposit accumulating around the nozzle holes 23 can be reduced, similarly to the ninth embodiment.

Eleventh Embodiment

Figure 12A:
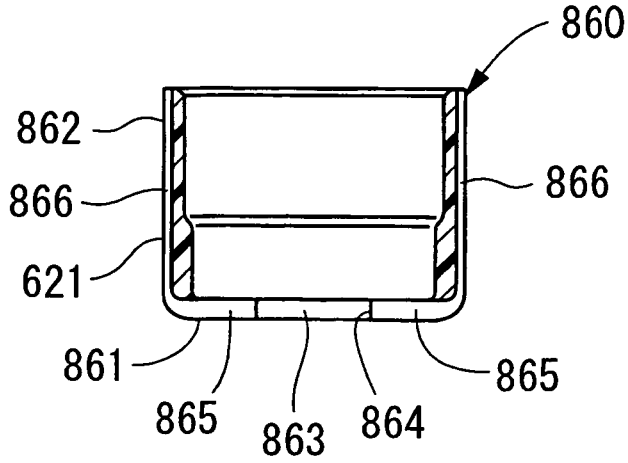
FIG. 12A is a cross sectional side view showing a sleeve of the fuel injection valve.
Figure 12B:
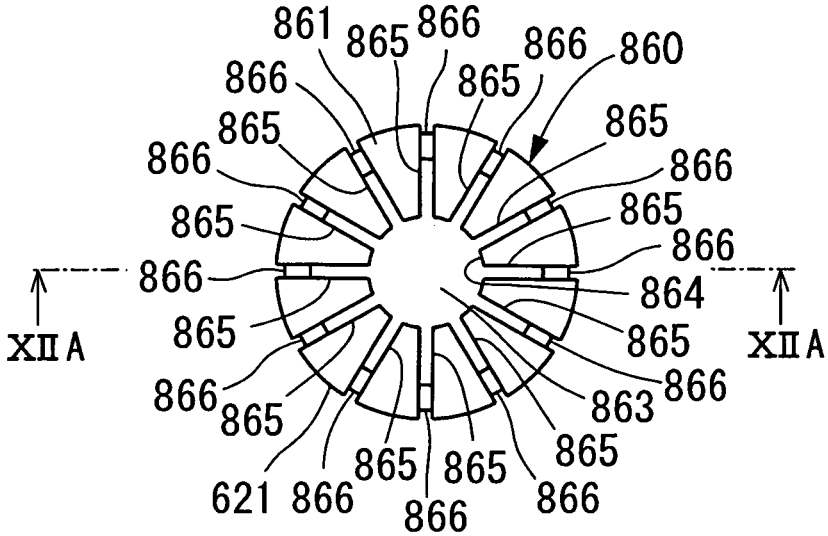
FIG. 12B is a bottom view of the sleeve, according to an eleventh embodiment of the present invention.

The fuel injection valve 10 of the eleventh embodiment is described in reference to FIGS. 12A, 12B. FIG. 12A is the partially cross sectional side view taken along the line XIIA-XIIA in FIG. 12B. FIG. 12B is a view showing a sleeve 860 when being viewed from the axially opposite side of the fuel inlet of the fuel injection valve 10.

In this embodiment, the sleeve 860 has a bottom portion 861 and a cylindrical portion 862. The bottom portion 861 has a radially center portion having an inner circumferential periphery 864 defining an opening 863. The bottom portion 861 of the sleeve 860 has grooves 865 that respectively radially extend outwardly from the inner circumferential periphery 864 defining the opening 863 to the radially outer side. The cylindrical portion 862 of the sleeve 860 has an outer circumferential periphery 621 having side grooves 866, which axially extend. Each of the side grooves 866 has one end that communicates with the radially outer end of the groove 865 formed in the bottom portion 861. The side groove 866 has the other end that extends to the axial end of the cylindrical portion 862 on the axially opposite side of the bottom portion 861. In this structure, fuel is introduced to the radially outer end of the bottom portion 861 through the grooves 865, and the fuel is further introduced to the side of the fuel inlet in the sleeve 860 through the side grooves 866 by capillary phenomenon. Therefore, the fuel is evaporated in the cylindrical portion 862 of the sleeve 860 on the side of the outer circumferential periphery 621 in locations further distant from the nozzle holes 23. Therefore, fuel accumulating around the opening 863 of the sleeve 860 in the vicinity of the nozzle holes 23 can be further removed. In addition, an amount of deposit accumulating around the nozzle holes 23 can be reduced.

The side grooves 866 may extend to a midway point between the tip end of the cylindrical portion 862 on the side of the bottom portion 861 and the tip end of the cylindrical portion 862 on the axially opposite side of the bottom portion 861.

Twelfth Embodiment

Figure 13A:
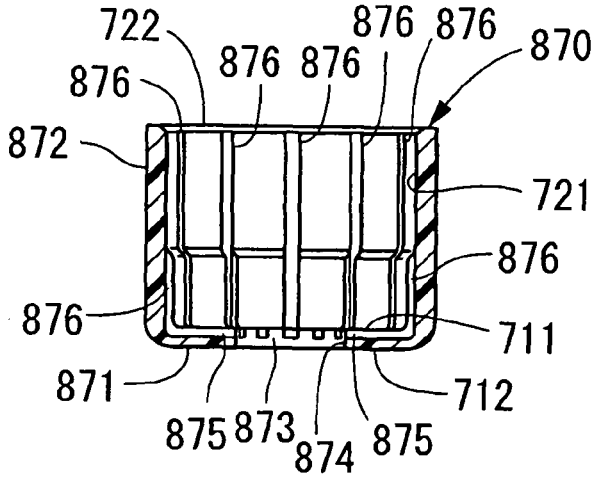
FIG. 13A is a cross sectional side view showing a sleeve of the fuel injection valve.
Figure 13B:
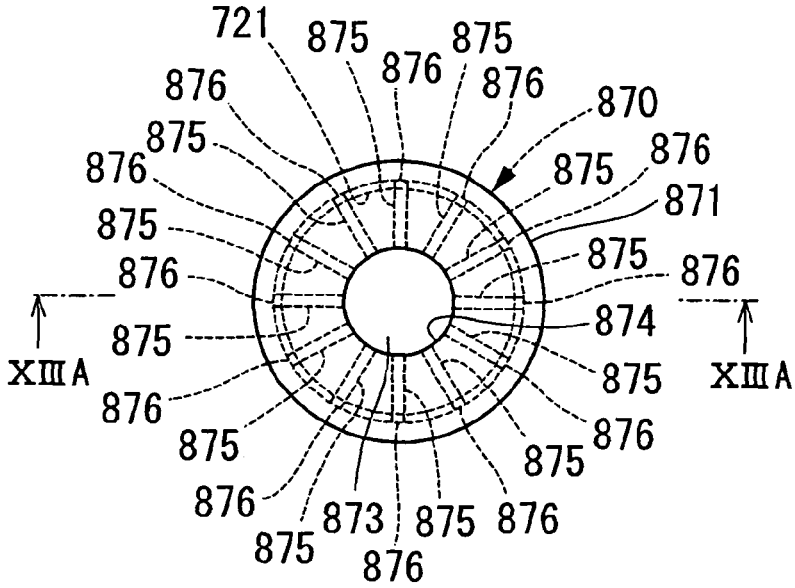
FIG. 13B is a bottom view of the sleeve, according to a twelfth embodiment of the present invention.

The fuel injection valve 10 of the twelfth embodiment is described in reference to FIGS. 13A, 13B. FIG. 13A is the partially cross sectional side view taken along the line XIIIA-XIIIA in FIG. 13B. FIG. 13B is a view showing a sleeve 870 when being viewed from the axially opposite side of the fuel inlet of the fuel injection valve 10.

In this embodiment, the sleeve 870 has a bottom portion 871 and a cylindrical portion 872. The bottom portion 871 has a radially center portion having an inner circumferential periphery 874 defining an opening 873. In this embodiment, the bottom portion 871 of the sleeve 870 has grooves 875 axially on the side of the nozzle plate 22. That is, each of the grooves 875 recesses from an end surface 711 of the bottom portion 871 of the sleeve 870 on the side of the nozzle plate 22 to an end surface 712 of the bottom portion 871 on the axially opposite side of the nozzle plate 22. The groove 875 is formed midway through the thickness of the bottom portion 871. The groove 875 radially extends outwardly from the inner circumferential periphery 874 defining the opening 873 to an inner circumferential periphery 721 of the cylindrical portion 872 on the radially outer side of the inner circumferential periphery 874. The cylindrical portion 872 of the sleeve 870 has the inner circumferential periphery 721 having side grooves 876, which substantially axially extend. Each of the side grooves 876 has one end that communicates with the radially outer end of the groove 875 formed in the bottom portion 871. The side groove 876 has the other end that opens to an axial end 722 axially on the opposite side of the bottom portion 871 with respect to the cylindrical portion 872. That is, the end of the side groove 876 axially on the opposite side of the bottom portion 871 is an opening end formed between the valve body 20 and the sleeve 870 when the sleeve 870 is connected with the valve body 20. In this structure, fuel is introduced to the radially outer end of the bottom portion 871 through the grooves 875 formed in the bottom portion 871, and the fuel is further introduced to the axial end 722 of the sleeve 870 axially on the side of the fuel inlet in the sleeve 870 through the side grooves 876 by capillary phenomenon. Thus, the introduced fuel is evaporated midway through the side groove 876 or is evaporated in the axial end 722 on the axially opposite side of the bottom portion 871 with respect to the cylindrical portion 872, so that this evaporated fuel is vent to the outside through the axial end 722. In this structure, fuel accumulating around the opening 873 of the sleeve 870 in the vicinity of the nozzle holes 23 can be removed. In addition, an amount of deposit accumulating around the nozzle holes 23 can be reduced.

In this embodiment, as described above, the side grooves 876 substantially axially extend to the axial end 722 on the axially opposite side of the bottom portion 871 with respect to the cylindrical portion 872. However, in a structure, in which a gap is formed in an axially midway point between the sleeve 870 and the valve body 20, the side grooves 876 may axially extend to this gap in this axially midway point. In this structure, fuel is evaporated in the ends of the side grooves 876 located at this axially midway point of the cylindrical portion 872. This end of the side grooves 876 is located on the axially opposite side of the bottom portion 871. Subsequently, the evaporated fuel is vent to the outside through the gap between the sleeve 870 and the valve body 20.

Other Embodiment

The grooves 38, 74, 84, 94, 106, 112, 145, 845, 855, 865, 875 of the sleeves 30, 70, 80, 90, 100, 110, 140, 840, 850, 860, 870 may be at least partially coated to form a coated portion in the structures of the above ninth embodiment to the twelfth embodiment. This coated portion enhances suction force generated by capillary phenomenon to draw fuel. This coated portion can be formed by providing a coated layer on the surface of the sleeve 30, 70, 80, 90, 100, 110, 140, 840, 850, 860, 870 having the grooves. This coated layer may have a hydrophilic property or a lipophilic property, for example. In this structure, fuel accumulating in the inner circumferential periphery defining the opening can be quickly drawn by the coated portion into the grooves. Thus, fuel accumulating around the opening can be quickly removed.

The inner circumferential periphery defining the opening is substantially in parallel with the center axes of the sleeve and the valve body 20, in the above ninth to the twelfth embodiment. However, the inner circumferential periphery may be slanted with respect to the center axis of the valve body 20. In this structure, the inner circumferential periphery defining the opening is preferably slanted by a small angle with respect to the center axis of the valve body. Even in the structure, in which the inner circumferential periphery is slanted with respect to the center axis of the valve body, the inner circumferential periphery preferably has a substantially linear cross section with respect to the center axis of the valve body.

The grooves of the sleeve substantially linearly extend from the inner circumferential periphery to the radially outer side, in the above ninth embodiment to the twelfth embodiment. However, the grooves may be bent in a radially midway point. The grooves may be formed in a curved shape, and the like.

The above structures of the embodiments can be combined as appropriate.

Various modifications and alternations may be diversely made to the above embodiments without departing from the spirit of the present invention.

What is claimed is:

1. A fuel injection valve comprising:

a valve body that has a valve seat;

a nozzle plate that is located on an injection side of the valve body, the nozzle plate having a nozzle hole, through which fuel is injected from the injection side of the valve body; and a sleeve that includes a cylindrical portion and a bottom portion and partially covers an end of the nozzle plate on an opposite side of the nozzle plate with respect to the valve body, wherein the bottom portion of the sleeve has an opening on the opposite side of the nozzle plate with respect to the valve body, the opening being defined by an inner circumferential periphery, through which fuel, which is injected from the nozzle hole, passes, and the sleeve has at least one groove that extends from the inner circumferential periphery outwardly in a substantially radial direction of the bottom portion of the sleeve to an outer circumferential periphery of the bottom portion of the sleeve, the cylindrical portion extends from the outer circumferential periphery of the bottom portion of the sleeve in an axial direction opposite from a fuel injection direction, the cylindrical portion has an outer circumferential periphery on a radially outer side thereof, and the at least one groove further extends along the outer circumferential periphery of the cylindrical portion in said axial direction opposite from the fuel injection direction.

2. The fuel injection valve according to claim 1, wherein the inner circumferential periphery of the bottom portion has a substantially linear cross section with respect to a center axis of the valve body.

3. The fuel injection valve according to claim 1, wherein the inner circumferential periphery of the bottom portion is substantially in parallel with the center axis of the valve body.

4. The fuel injection valve according to claim 1, wherein the at least one groove is defined in a wall surface of the sleeve, and the wall surface of the sleeve is at least partially coated for enhancing suction force drawing fluid.

5. The fuel injection valve according to claim 1, wherein the at least one groove includes a plurality of grooves that is arranged with respect to a circumferential direction of the sleeve, each of the plurality of grooves has a circumferential width with respect to the circumferential direction of the sleeve, the plurality of grooves, which are adjacent to each other with respect to the circumferential direction of the sleeve, are distant for a circumferential distance, and the circumferential width is less than the circumferential distance.

6. The fuel injection valve according to claim 1, wherein the plurality of grooves is arranged with respect to the circumferential direction of the sleeve at substantially regular intervals.

* * * * *